United States Patent [19]

Ward

[11] 4,331,272

[45] May 25, 1982

[54] FRAMELESS BACK PACK WITH TENT

[76] Inventor: Russell G. Ward, 2050 SW. 71st Ave., Portland, Oreg. 97225

[21] Appl. No.: 229,739

[22] Filed: Jan. 29, 1981

[51] Int. Cl.[3] ..... A47G 9/00

[52] U.S. Cl. ..... 224/154; 135/1 R

[58] Field of Search ..... 224/154, 155, 156; 135/1 R

[56] References Cited

U.S. PATENT DOCUMENTS

| | | | |
|---|---|---|---|
| 510,239 | 12/1893 | Carr | 224/154 |
| 650,554 | 5/1900 | Conley | 224/154 |
| 672,731 | 4/1901 | Conley | 224/154 X |
| 1,198,773 | 9/1916 | Robinson | 224/154 |
| 1,464,875 | 8/1923 | Hull et al. | 224/156 X |
| 4,035,855 | 7/1977 | Kim | 224/156 X |
| 4,239,135 | 12/1980 | Armstrong | 224/154 |

*Primary Examiner*—Steven M. Pollard

*Attorney, Agent, or Firm*—James D. Givnan, Jr.

[57] ABSTRACT

A back pack formed from a folded sheet of fabric with the sheet constituting the floor of a tent with a tent canopy being attached to the sheet perimeter. Sleeves formed in the sheet of fabric slidably receive a length of webbing which functions as a pack harness and also to apply compression loads to the loaded pack. Zipper halves sewn to the fabric sheet retain the pack in the general configuration of a back pack and define the lateral limits of a pack stowage area which area is additional to a tent canopy stowage area. Corner located zippers permit the forming of sleeve-like passageways through which webbing segments pass, which passageways constitute still another stowage area of the pack. Additional pack compression is accomplished by a line extending through the above mentioned sleeves and through an additional pair of sleeves integral with the fabric sheet.

4 Claims, 8 Drawing Figures

FRAMELESS BACK PACK WITH TENT

BACKGROUND OF THE INVENTION

The present invention relates to a frameless pack carried by persons engaged in outdoor activities such as back packing, hunting, etc. The conventional back pack includes a rigid frame to which is attached a fabric enclosure within which the user's gear is stowed. The relationship of available stowage space to pack weight is low by reason of the weight of the pack's rigid components and the limited size of the fabric enclosure in place thereon. To the extent known, prior art back packs make no provision for both a tent, integral with the pack, and also stowage space for the user's gear.

With regard to the known prior art, U.S. Pat. No. 41,418 discloses a combination hammock and knapsack with limited provision made for the stoage of a small quantity of additional gear. U.S. Pat. No. 3,822,813 discloses a back pack frame attachable to an upright support, such as a tree, with the pack frame being disposed horizontally with extensions supporting a tent canopy. U.S. Pat. Nos. 3,158,299 and 3,848,279 disclose packs which include rigid frame members which may be used as tent canopy supports.

SUMMARY OF THE PRESENT INVENTION

The present invention is embodied within a pack of substantial volumetric capacity yet not requiring a rigid frame. The present pack, by dispensing with rigid components achieves substantial weight savings without jeopardizing pack portability. Zipper and webbing components of the pack permit a sheet of material, which constitutes a floor of a tent, with the tent canopy being attached to the floor perimeter. That portion of the pack overlying the user's back and hips defines a stowage area suitable in size for both tent canopy storage as well as a substantial quantity of gear.

Important objectives of the present invention include the provision of a back pack having a tent canopy integral therewith having a combined weight less than conventional back packs yet providing expedition class stowage area; the provision of a pack formed essentially from a sheet of fabric which sheet functions as a tent floor for a tent of at least a two-person size; the provision of a pack having both zipper and webbing components the latter disposed within sleeves sewn in the fabric sheet which permit compression forces to be applied to the pack when loaded to shape same in an easily carried pack of compact size; the provision of a pack having shoulder engaging portions formed from zippered together corners of the fabric sheet with the joined corners being positionable to overlie the chest of the user and provide highly accessible additional storage space during carrying of the pack.

DETAILED DESCRIPTION OF THE PREFERRED EMBODIMENT

The present pack is formed from essentially a single sheet of fabric at 1, preferably of heavy nylon duck fabric, cut in rectangular shape.

Figure 4:
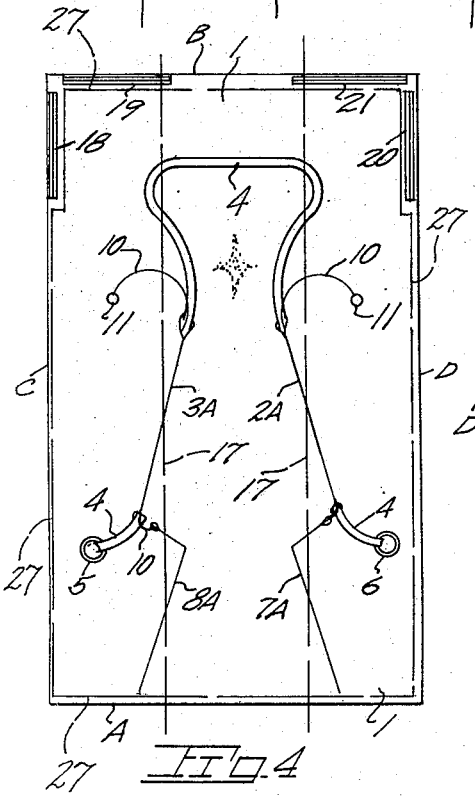
FIG. 4 is a plan view of the tent floor from which the present pack is formed.
Figure 4A:
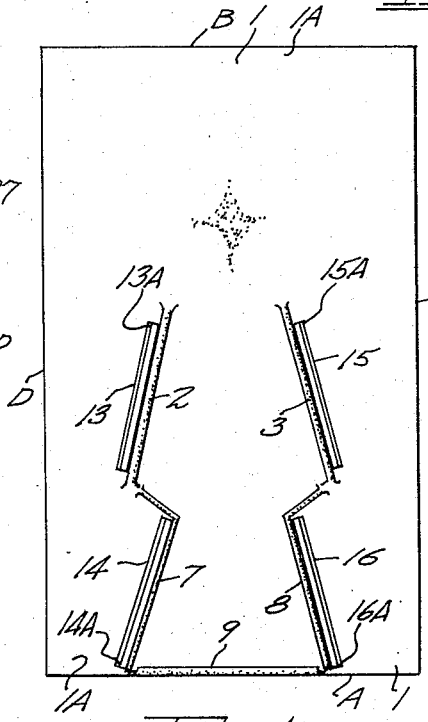
FIG. 4A is a plan view of the reverse side of the fabric sheet shown in FIG. 4.

With initial attention to FIGS. 4 and 4A, the rectangular sheet 1 has opposite end edges A and B of lesser length than side edges at C and D.

A first pair of tubular sleeves at 2 and 3 are each integrally formed on the sheet underside 1A (FIG. 4A) by a line of stitching at 2A and at 3A and through which sleeves pass lengths of a webbing at 4. Rings at 5 and 6, at each end of the webbing, serve as part of a later described coupling and as part of the pack harness. With attention still to FIGS. 4 and 4A, a second pair of sleeves at 7 and 8 are likewise formed each being of irregular direction and terminating proximate a sleeve of the first mentioned pair of sleeves 2 and 3. The additional or second pair of sleeves 7 and 8, formed by lines of stitching at 7A–8A, receive a continuous length of a sturdy line at 10 which is additionally routed, along with webbing 4, through first pair of sleeves 2 and 3 and terminates in exposed pulls 11 for imparting compression to a loaded pack. An intermediate sleeve 9 receives the line 10 between sleeves 7 and 8.

The above mentioned sleeves are conveniently formed on sheet 1 by the stitching of folder over elongate tubular portions of the sheet. Sleeves 2 and 3 are of a size to permit snug passage therethrough of webbing 4 permitting later compression of the pack. Sleeves 7 and 8 may be substantially smaller in their transverse dimension as only line 10 passes therethrough in a slidable manner.

Figure 5:
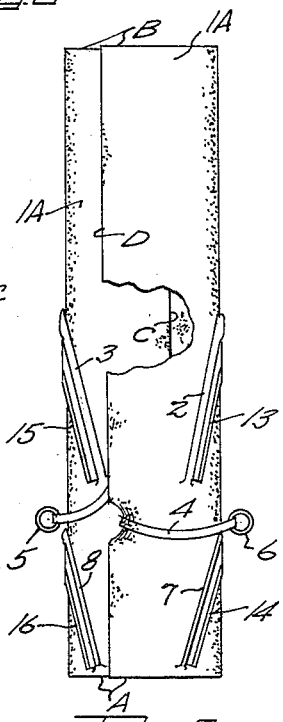
FIG. 5 is a plan view of the fabric sheet folded along fold line indicated in FIG. 4.

With attention now to FIG. 4A, engageable zipper halves are indicated at 13–14 and 15–16 each half sewn in place along one of the above noted sleeves. Upon lengthwise folding of sheet 1 in an overlapped manner along fold lines 17 in the right side up view of FIG. 4, the zipper halves will thence be located approximately as viewed in FIG. 5. The webbing rings 5 and 6 are extracted from the folded sheet to facilitate their later use as part of the pack harness. With the pack in the approximate lengthwise, overlapped configuration of FIG. 5, the lower portion of the pack (that portion adjacent edge A) is lifted and folded back to lay on or over the mid-portion of the now overlapped sheet. Remote zipper half ends 13A–14A and zipper half ends at 15A–16A will, upon being manually positioned proximate one another, permit zippering together of halves 13–14 and 15–16 by the pull component of each zipper being drawn downwardly the length of the zipper halves. It will be appreciated that the pack when zippered will have a storage area laterally defined by the joined zippers.

Figure 6:
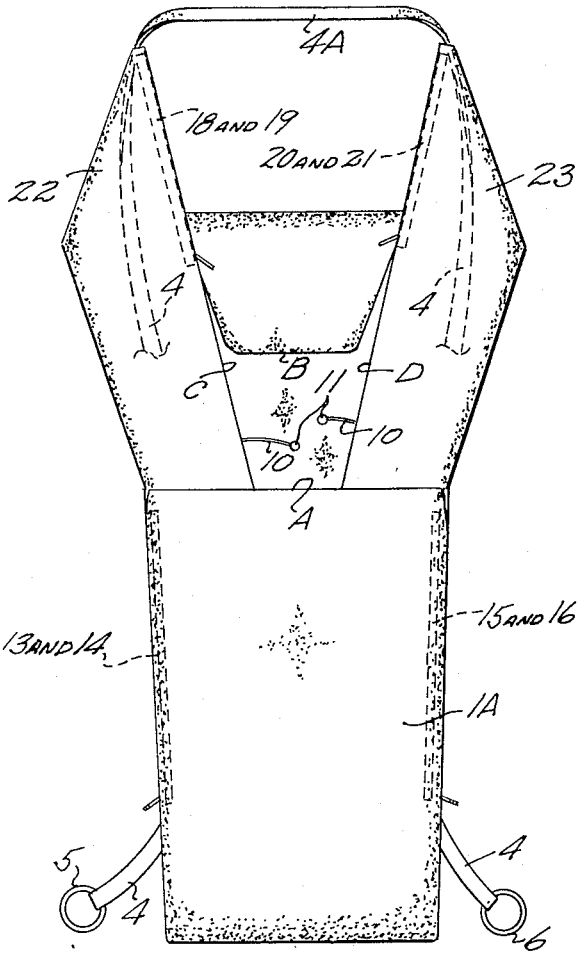
FIG. 6 is an enlarged plan view of the partially formed pack.

The pack is now shaped as shown in the slightly enlarged scale front view of FIG. 6. A substantial area of sheet 1 extends outwardly from or beyond the folded and zippered together last described portion of the pack.

Attention is again directed now to FIG. 4, wherein corner mounted zipper halves are indicated at 18–19 and 20–21. In place on a zipper half of each pair of corner zippers is a pull serving to join zipper halves 18–19 and 20–21. Zippering is subsequent to positioning of segments of webbing 4 to extend outwardly past each of the two sheet corners. In this last operation of zippering together the edges of each corner, it is to be understood that webbing 4 may be extracted to its maximum extent from sleeves 2 and 3 so as to extend beyond the corner apices.

Figure 7:
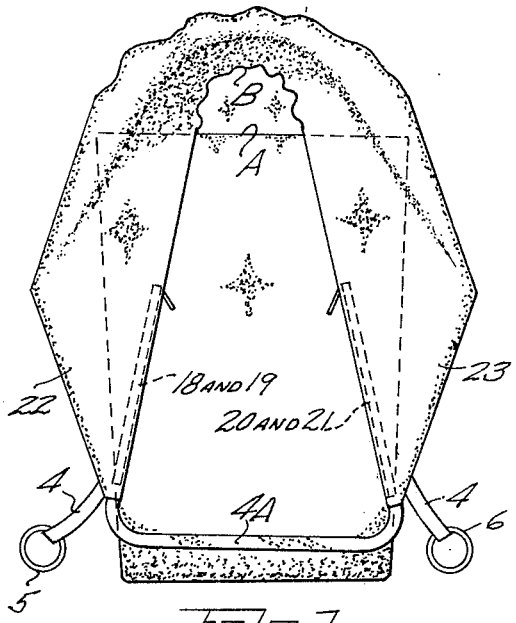
FIG. 7 is a plan view of the pack in its completed configuration for carrying on the user's torso.

The zippered together corner edges and adjacent corner areas of sheet 1 constitute tapered sleeve-like structures 22 and 23 which ultimately are positioned to overlie the wearer's chest. That area of sheet 1 adjacent edge B and intermediate the sleeve-like structures may be shaped to overlie pack contents (FIG. 7) or, if desired, shaped to provide at least a partial hood for the user's head. The sleeve-like structures 22 and 23 each define a closed space accessible via the corner zippers to provide convenient and auxiliary storage space for small items often used during hiking.

Figure 1:
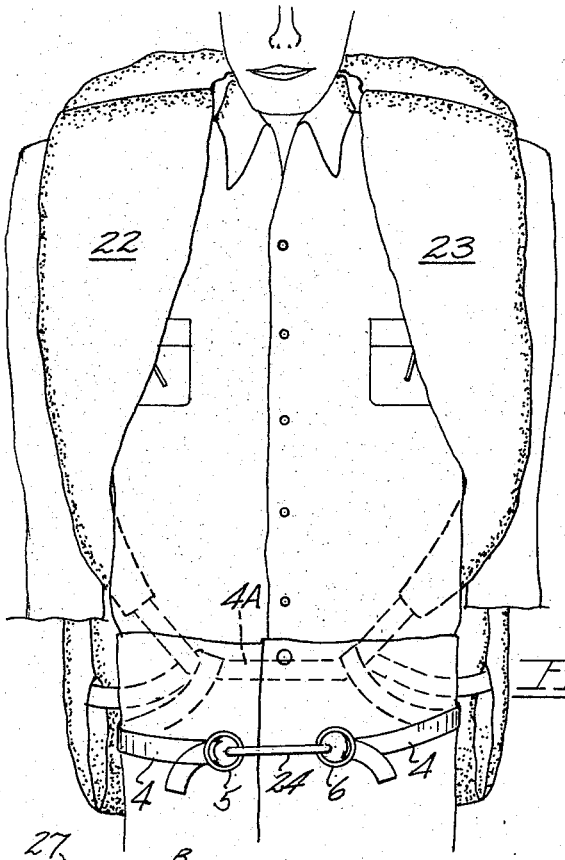
FIG. 1 is a front elevational view of the pack in use.

The pack harness includes rings 5 and 6 at each end of webbing 4 with end segments of the webbing, as shown in FIG. 1, being passed over an exposed segment of webbing at 4A and the end segments thereafter brought forwardly about the lower torso to permit coupling by means of a snap-on type such as a snap link clip 24. Adjustment of webbing 4 may be accomplished by use of paired locking rings through which one end of the webbing may be entrained in a frictionally locked manner.

Figure 2:
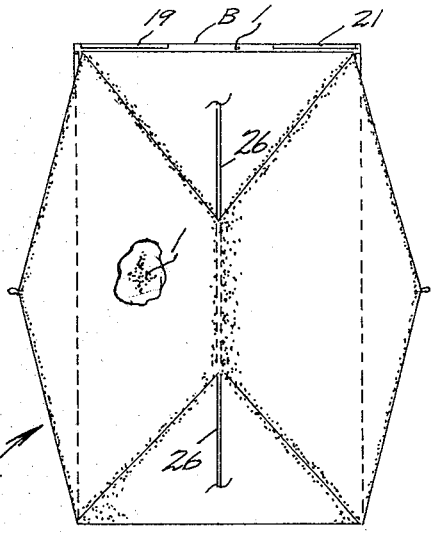
FIG. 2 is a plan view of a tent canopy component of the pack.
Figure 3:
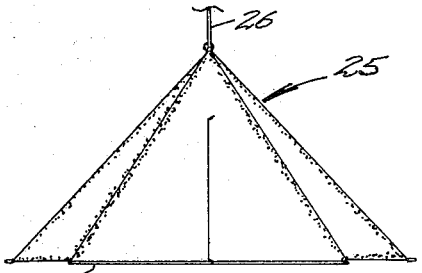
FIG. 3 is an end elevational view of the tent canopy shown in FIG. 2.

In one embodiment of the pack, fabric sheet 1 is of a length of 90 inches with a width of 60 inches to provide adequate floor area for a two or three person tent generally indicated at 25 in FIGS. 2 and 3 with a ridge line at 26. Details of the tent canopy are not pertinent to the present back pack invention other than to say the tent canopy is preferably formed from lightweight, synthetic material of windproof nature and lending itself to compact folding. The canopy perimeter is secured as by stitching at 27 about the margin of fabric sheet 1, inwardly of corner zippers 18–19 and 20–21, with a tent end wall being provided with a suitable entrance fly. Side pullout portions of the tent increase tent space.

Fabric sheet 1 is preferably formed from that type of nylon fabric sold under the registered trademark Cordura.

Load carrying areas of the pack, in addition to the tent canopy stowage area within the lengthwise folds of the sheet, is defined laterally by mated zipper halves 13–14 and 15–16.

Compression of the load is by tensioning of webbing 4 to extract the ends of same and by tensioning and tying line 10. In instances where the pack is not substantially loaded it may be desirable to insert stiffening elements lengthwise of sleeves 2 and 3 to prevent sagging of the pack. Additional compression straps may also be added to the pack.

Importantly, dirt and moisture on the tent canopy is isolated from pack contents.

All earlier mentioned zipper components may of course be dispensed with in favor of other equivalent closure means such as snap type fasteners, Velcro strips, rod through eye appendages on the pack sheet and/or lacing.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A frameless back pack comprising in combination,
a fabric sheet of substantially rectangular shape,
a tent canopy joined at its perimeter to the edges of said sheet,
sleeve means integral with the sheet,
webbing slidably in place within said sleeve means and having exposed segments, exposed webbing end segments having harness components thereon,
zipper halves in place on the sheet in juxtaposition with said sleeve means and serving to retain an overlapped portion of the sheet in folded back configuration, the overlapped folded back configuration of the sheet defining a load receiving area of the pack,
corner mounted zipper halves located at each edge of the corners at one end of the sheet enabling joining of the edges to form sleeve-like passageways for webbing segments,
the folded back portion of the sheet adapted to overlie the user's back and hips, the sleeve-like passageways adapted to extend over the user's shoulders and thence downwardly to overlie the chest of the user, and
said exposed webbing segments comprising a harness for the pack, said harness including means coupling said harness components on the webbing end segments.

2. The pack claimed in claim 1 including additional sleeve means integral with the sheet, a line entrained through said sleeve means and said additional sleeve means and having pulls at its ends to enable compression of a loaded pack in conjunction with compression imparted by said webbing.

3. The pack claimed in claim 2 wherein said sleeve-like passageways additionally serve as load receiving areas of the pack conveniently disposed for user access during wearing of the pack.

4. The pack claimed in claim 3 wherein said sleeve-like passageways terminate during wearing of the pack rearwardly of the user's hips to facilitate engagement of that webbing passing outwardly from and adjacent said passageways for pack securement to the user.

* * * * *